United States Patent [19]

Verry

[11] Patent Number: 4,497,664

[45] Date of Patent: Feb. 5, 1985

[54] EROSION OF A SOLID SURFACE WITH A CAVITATING LIQUID JET

[75] Inventor: Philippe Verry, Meylan, France

[73] Assignee: Alsthom-Atlantique, Paris, France

[21] Appl. No.: 539,900

[22] Filed: Oct. 7, 1983

[30] Foreign Application Priority Data

Oct. 7, 1982 [FR] France ..... 82 16798

[51] Int. Cl.[3] ..... B08B 3/02

[52] U.S. Cl. ..... 134/22.12; 134/34; 134/166 C; 134/167 C; 175/67; 239/524; 239/593; 299/17

[58] Field of Search ..... 134/22.12, 34, 166 C, 134/167 C; 239/524, 593, DIG. 7; 175/67; 299/17

[56] References Cited

U.S. PATENT DOCUMENTS

| | | | |
|---|---|---|---|
| 639,971 | 12/1899 | Griffiths | 239/593 |
| 749,232 | 1/1904 | Shaw | 239/593 X |
| 777,053 | 12/1904 | Wilson | 239/593 X |
| 1,401,176 | 12/1921 | Miller et al. | 239/524 |
| 2,156,370 | 5/1939 | Brownfield | 239/524 X |
| 2,279,374 | 4/1942 | Jung | 239/524 X |
| 3,528,704 | 9/1970 | Johnson . | |
| 3,785,572 | 1/1974 | Arnold et al. | 239/524 X |
| 3,807,632 | 9/1972 | Johnson . | |
| 4,193,635 | 3/1980 | Thiruvengadam . | |
| 4,342,425 | 8/1982 | Vickers | 175/67 X |
| 4,361,285 | 11/1982 | Koppehele et al. | 239/524 X |
| 4,389,071 | 6/1983 | Johnson et al. | 175/67 X |

*Primary Examiner*—Marc L. Caroff

*Attorney, Agent, or Firm*—Sughrue, Mion, Zinn, Macpeak, and Seas

[57] ABSTRACT

A solid surface is eroded by directing a liquid axially through a converging passage in a nozzle toward the surface, then deflecting the liquid in a lateral direction parallel to the surface while the liquid is subject to cavitation.

10 Claims, 4 Drawing Figures

EROSION OF A SOLID SURFACE WITH A CAVITATING LIQUID JET

BACKGROUND OF THE INVENTION

It is known that the erosion of a surface by cavitation results from rapid and irregular displacements of a liquidvapor interface in the region of that surface, on the occasion of the condensation of a vapor produced upstream in the liquid flow. It can specially result in the sudden implosion of bubbles of vapor inside a liquid in contact with that surface, such an implosion resulting from the application to this liquid of a pressure higher than the vapor pressure at the ambient temperature.

Although erosion by cavitation if often considered as an undesirable phenomenon, limiting the working life of certain hydraulic equipment, it is known that such an erosion can, for example, make possible the cleaning off of a surface layer from a metal wall. The working liquid conventionally used is water at normal temperature, and in the presence of an ambient pressure near to atmospheric pressure. Other liquids, temperatures, and ambient pressures, however, are sometimes used.

Erosion by cavitation can, for example be used during the dismantling of a nuclear generating station for the decontamination of parts where the greatest part of the radioactivity is concentrated in a thin surface layer. These parts are at present treated chemically, electrochemically, or by jets of water: The advantage of erosion by cavitation as compared with these methods is that it can be put into operation with water alone, without producing aerosols or radioactive effluents.

It is already known, for example, by U.S. Pat. No. 3,807,632 (Johnson) that a device for erosion of a solid surface by a cavitating jet exists. This known device consists of:

a source of a working liquid under high pressure, this liquid being vaporizable at the ambient temperature at a pressure lower than the ambient pressure;

a nozzle supplied by this source and forming a converging tube of "longitudinal" direction to form a high speed jet with this liquid while lowering the pressure of the liquid, and and to direct the jet to the surface to be eroded along this longitudinal direction;

and means of cavitation connected with this nozzle and operating on the jet to lower the pressure locally, partially vaporize the liquid, and creat the violent displacements of the liquid on the recondensation of the vapor downstream, in a condensation area where the pressure has been raised and which is in contact with the solid surface to be eroded.

In this device, many bubbles of vapor are formed in the liquid jet at a distance from the surface to be eroded. The jet containing these bubbles arrives on this surface perpendicularly to the latter. When the pressure rises, the bubbles implode, that is, condense suddenly. Certain of them implode on contact with the surface to be eroded. Only these are useful. It results from this that the efficiency of this device is low, the efficiency being measured by the ratio of the mass of material removed to the energy expended. This invention is intended to produce a simple and efficient erosion device.

SUMMARY OF THE INVENTION

Its subject is a device for eroding a solid surface by a cavitating flow, this device consisting of:

a source of a working liquid under high pressure, this liquid being vaporizable at the ambient temperature at a pressure lower than the ambient pressure;

a nozzle suppled by this source, and forming a converging tube in the "longitudinal" direction to form a high speed jet with this liquid while lowering the pressure of the liquid, and to direct this jet to the surface to be eroded along this longitudinal direction;

and means of cavitation connected to this nozzle and operating on the jet to lower the pressure locally, partially to vaporize it and to create violent displacements of the liquid during the recondensation of the vapor downstream, in a condensation area where the pressure has been raised and which is in contact with the solid surface to be eroded.

This device is characterized by the fact that the means of cavitation include a deflector fitted with means for positioning it in the vicinity of the surface to be eroded; the deflector receiving the jet as it leaves the nozzle, and deflecting it in a "lateral" direction to form the flow parallel to that surface. The downstream edge of the deflector forms an "active" ridge suitable for causing a separation of the flow and the formation of a pocket of vapor immediately down stream of this ridge between the separated flow and the surface to be eroded. Immediately downstream of this vapor pocket, the zone of bubble implosion is to be found.

An originality of the device as compared with the known devices with cavitating jets in use at present industrially is thus to produce the cavitation in a flow practically parallel to the surface to be eroded, making it possible to localize a greater number of agressive cavitations close to that surface, certain of these cavitations taking the form of bubbles in the course of implosion.

In fact, the mechanism of erosion according to this invention is essentially due to the phenomenon of the implosion of bubbles whereas the cavitating jets so far known cause successions of over/underpressures which are less favorable to the decontamination of superficial microfissures.

The invention also has as its subject the process of erosion using this device.

With the help of the schematic figures attached, we are going to describe, in a non-exhaustive way how the invention can be put into operation. It must be understood that the items described and represented can, without going outside the limits of the invention, be replaced by other items providing the same functions technically. When the same item is represented in several figures, it is given the same reference sign.

DESCRIPTION OF PREFERRED EMBODIMENTS

Figure 1:
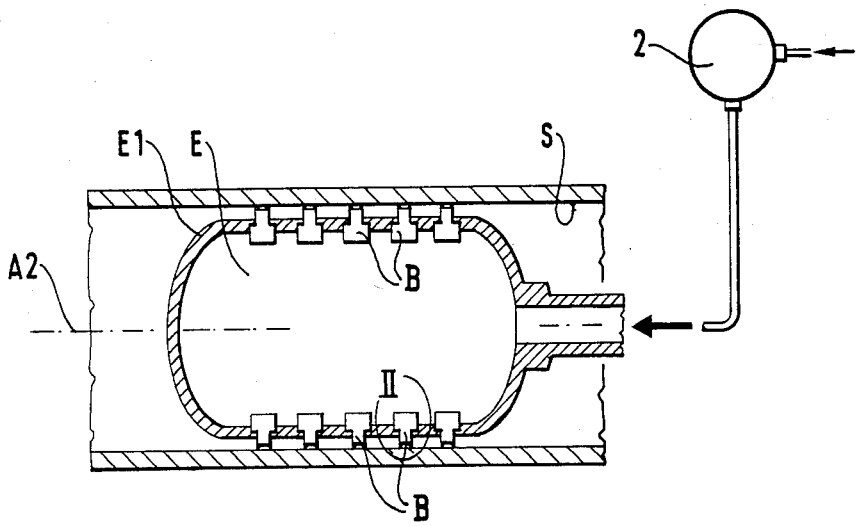
FIG. 1 represents a descaling device for the inside of a fouled pipe, this device consisting of several eroding heads, each one according to the invention, this descaling device being viewed on a section in the axial plane.
Figure 2:
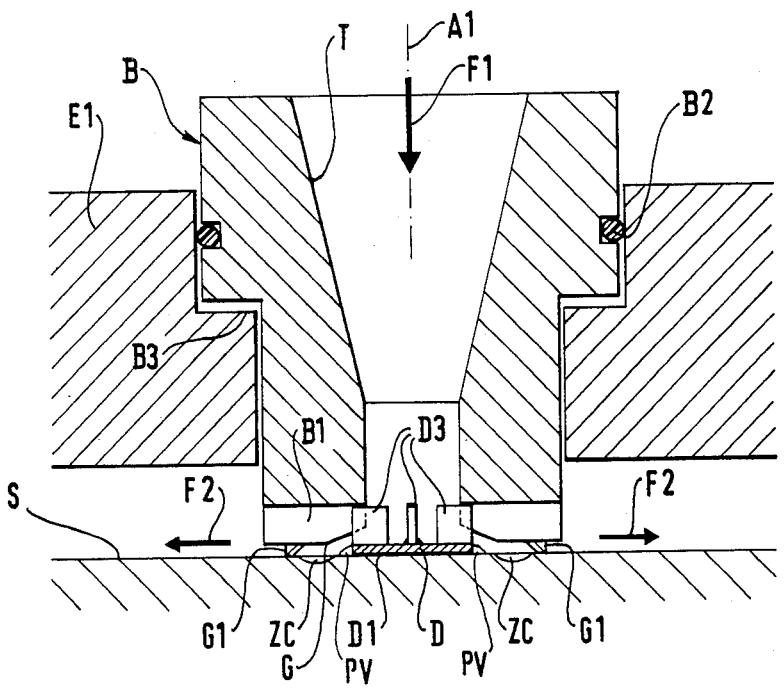
FIG. 2 represents a head of the device described above, seen in a section passing through the axis of this head, on an enlarged scale, in the form of detail II of FIG. 1.
Figure 3:
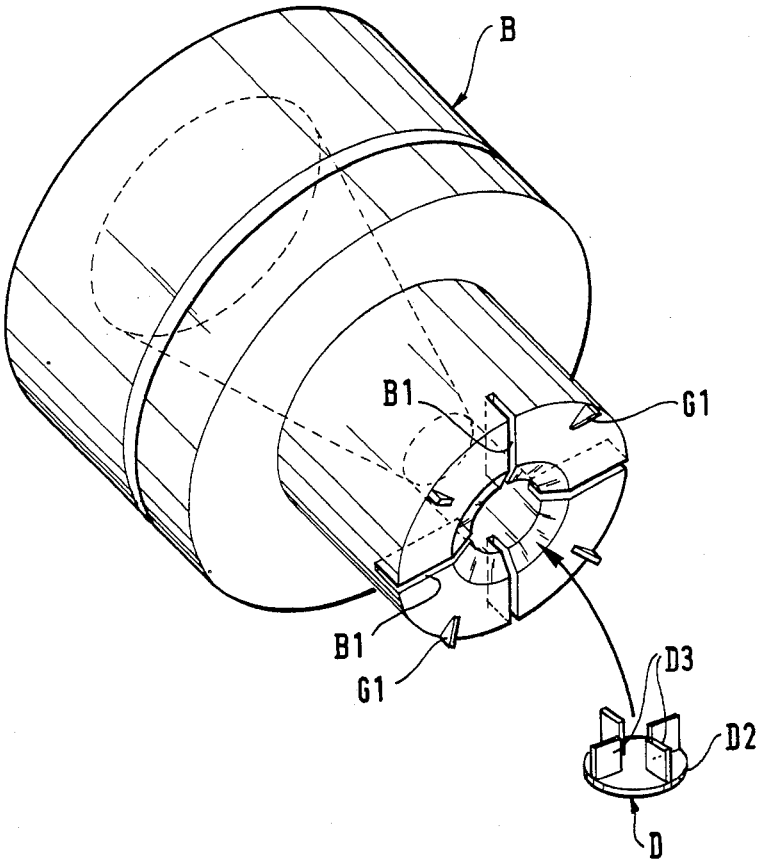
FIG. 3 is an exploded perspective view of the end of the same head from the side of the surface to be eroded.

The devices according to the invention represented by the FIGS. 1, 2, and 3 consist of known items that are:

a source 2 of a working liquid under high pressure, this liquid being vaporizable at ambient temperature at a pressure less than the ambient pressure;

and a nozzle B, supplied from this source and forming a converging tubing T in the "axial" direction to form from this liquid a very high speed jet while lowering the pressure of the liquid, and then to change this jet into a radial flow parallel to the surfaces to be eroded.

More especially, the axial direction is represented by an arrow F1, FIG. 2, and in this case consists of the "longitudinal" direction previously mentioned, each radial direction making, on the other hand, a direction called "lateral".

The working liquid is water and its source is a pump 2 represented in FIG. 1 and supplying several nozzles B in parallel.

In accordance with this invention, the phenomenon of cavitation is caused by means of a deflector D offering a support surface D1 coming into contact with the surface S to be eroded in such a way as to form the said means for positioning it. This deflector receives the jet coming from the nozzle B and deflects it to the "radial" directions parallel to this surface. Its downstream edge D2 forms an "active" ridge able to cause separation of the jet and the formation of a pocket of vapor PV, FIG. 2, immediately downstream of this ridge between the separated jet and the surface to be eroded.

The said radial directions are represented by the arrows F2. The condensation zone ZC is situated immediately downstream of the vapor pocket PV. This is the zone in which the surfaces S is eroded.

Preferably, and as shown, the nozzle B at its output and as a continuation of the axial convergent tube T, a guidance profile G turned towards the radial directions as regards the deflector D, creating a local minimum of the section for the passage of the liquid noticeably to the right of the active ridge D2 of the deflector while approaching the surface to be eroded, then causing this section of passage to increase gradually down stream of the deflector and with respect to the surface to be eroded S to make the pressure rise and so fix the position of the condensation zone.

The guide profile G shows, in a zone of increased passage section downstream of the cavitation zone after the deflector D, radial support fins G1, FIG. 3, extending according to the axial direction to come into contact with the surface S to be eroded and maintain the predetermined distances between this profile and this surface while easing the sliding of the nozzles on the surface.

Figure 4:
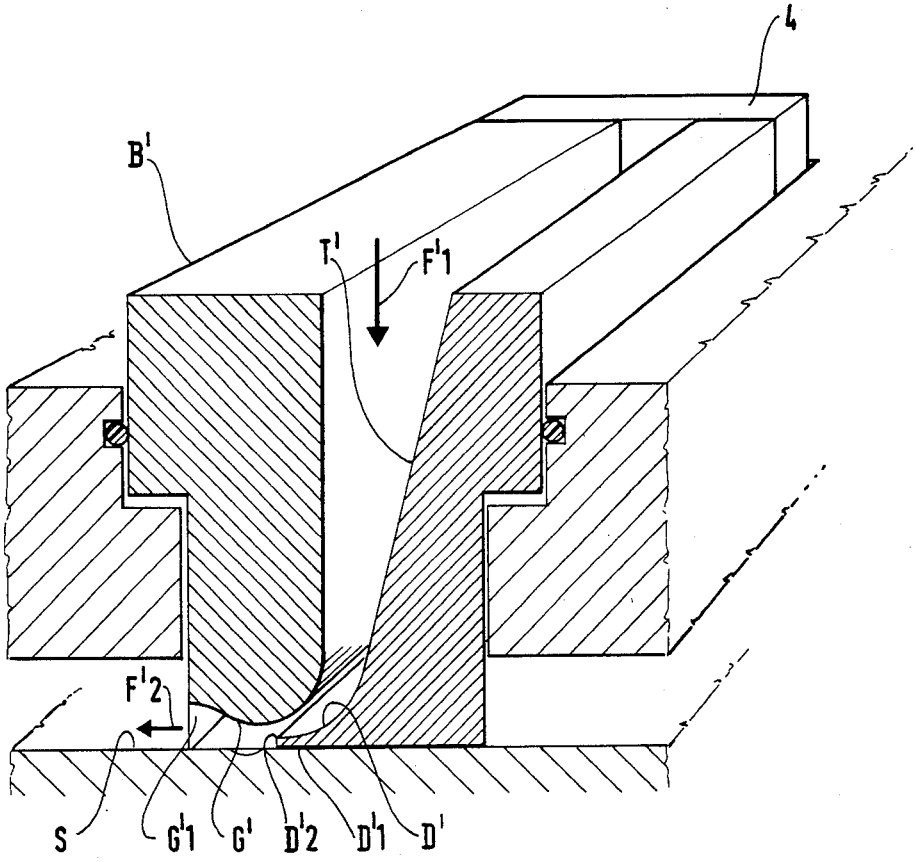
FIG. 4 is a perspective view of a head with a laminar jet according to the invention, in perspective with a section through a plane perpendicular to the sheet of the jet and the surface to be eroded.

The arrangements that have just been described relating to the axial jet head represented in FIGS. 2 and 3 are to be found in an analogous manner in the laminar jet head represented in FIG. 4.

In the case of the axial jet head, the nozzle B and the deflector D show general forms of revolution about a single longitudinal axis A1. The support surface of the deflector D is perpendicular to this axis. The active ridge D2 is circular and coaxial with the nozzle. The deflector results at least partially from the increase of the circumferences of the coaxial circles of the nozzle as the liquid becomes more remote from that axis.

In the example shown, the downstream part, that is, radially external, of the guide profile G is flat and parallel to the surface to be eroded S, so as to simplify the manufacture of the nozzle. The gradual increase of the section of the liquid passage indicated above thus results only from the increase in the circumferences of the coaxial circles at the nozzle on becoming remote from the latter. This increase is preferably equal to at least 50% for a distance of 5 mm as from the active ridge.

Preferably, the deflector D is joined to the nozzle B by junction fins fixed to the deflector in planes passing through the axis of the nozzle A1, divided angularly around that axis and penetrating into the grooves B1 cut into the nozzle (see FIG. 3).

More exactly, the deflector D has the form of a circular disk with two parallel plane faces, the plane face facing the nozzle having four junction fins D3 separated angularly by 90° around the axis of the nozzle and leaving a central space free between them. This central space must be fitted with a jet deviator (not shown), to improve the flow.

The invention can be applied to the cleaning of the internal surface S of a metal pipe polluted by radioactive products (see FIGS. 1 and 2).

In this case and others, preferably the device consists of several nozzles B, each fitted with a deflector D, fitted in the same enclosure E with their outputs directed towards the exterior of this enclosure, the interior space of the latter being supplied by a source of working liquid under high pressure 2 common to all the nozzles. These nozzles are arranged to slide in the casing so that the pressure held in this internal space keeps the support fins G1 of all the nozzles in permanent contact with the surface S to be eroded.

The enclosure E is circular about the axis A2 of the piping and slides along it turning itself round. It may carry, for example, 40 nozzles B. These can slide along their longitudinal axis A1, and hence perpendicularly to the axis A2, in the casing of the enclosure, because of the O-ring B2. This ring gasket is placed at a diameter suitable for adjusting the force of contact to a convenient figure. The housing of the nozzles in the casing of the enclosure forms a stop B3, limiting the movement of the nozzle towards the exterior. The enclosure E always has a diameter slightly less than that of the tube, and it is introduced into the latter before being put under pressure, so permitting the retraction of the nozzles into the interior of the enclosure.

Preferably, the minimum water passage section in the nozzle B fitted with its deflector D is less than 100 $mm^2$ to obtain a high erosion efficiency.

In fact, the efficiency of the device is increased by the reduction of the general dimensions of the flow. For a given output of water and a given critical passage section, it is always more advantageous to make use of two small sized cavitation heads rather than a single head exactly the same, but larger.

More exactly, by way of an example, the nozzle B can be made of brass, the outlet diameter of its tube T can be 8 mm, the deflector D can be made of brass, and have a diameter of 10 mm and a thickness of 1 mm, the water passage section to the right of the active ridge D2 being 1 mm high.

In these conditions, trials have shown that the use of this process makes it possible to clean up a surface of $0.25^2$ of stainless steel in 4 hours to a thickness of more than 10 microns with a pressure of 300 bars and a flow rate of 1 liter per second. Furthermore, the tests showed that the nozzle and the deflector were not reoded, and that the ridge D2 was not eroded either.

The invention can be used not only with axial jet nozzles with a circular section, but also with nozzles of dihedral form, giving a laminar jet, by using the device shown in FIG. 4.

The nozzle B then prolongs perpendicularly to the plane of the figure, with a width far greater than its thickness, the latter only being shown, the form of the tube T', of the deflector D', and of the guide profile G' remaining constant over all the useful length of the nozzle, and forming an active rectilinear ridge D'2 and a support surface D'1. Support fins for the nozzle ae shown at G'1. The nozzle B is made up of two cylindrical blocks (not of revolution), with generatrices perpendicular to the plane of the sheet. One of these blocks in its lower part, forms the guide profile G', and the other, also in its lower part the deflector D'. These two blocks are joined by end pieces 4. In this case, the gradual increase of the water passage section downstream of the deflector results from the fact that the guide profile G' is separated from the surface S to be eroded. The divergence of the flow ensuring the increase in the pressure is more difficult to achieve than in the model based on forms of revolution.

What is claimed is:

1. In a device for the erosion of a solid surface by a cavitating flow, said device comprising:

a source (2) of a working liquid at high pressure, said liquid being vaporizable at the ambient temperature at a pressure lower than the ambient pressure, at least one nozzle (B) supplied by said source with liquid, and forming a converging tube (T) in its "longitudinal" direction, so as to form said liquid into a high speed jet while reducing the pressure of the liquid, and to direct said jet to the surface (S) to be eroded along said longitudinal direction, and means for effecting cavitation connected to said nozzle to lower the pressure of the liquid locally, to vaporize it partially, and to create violent displacements of the liquid on recondensation of the vapor downstream in a condensation area (ZC) where the pressure is increased and which is in contact with the surface to be eroded, the improvement wherein the means for effecting cavitation include a deflector (D), fitted to said nozzle by means (D3) positioning it in the neighbourhood of the surface (S) to be eroded, said deflector being oriented so that it receives the jet on its exit from the nozzle (B) and deflects it in a "lateral" direction to form a flow parallel to said surface, said device including means (G1) for maintaining said nozzle at a predetermined distance from said surface, and said deflector having a downstream edge forming an "active" ridge (D2) for causing separation of the flow and for formation of a pocket of vapor (PV) immediately downstream of said ridge between the separated flow and the surface to be eroded.

2. A device according to claim 1, wherein said nozzle (B) has at its exit and in continuation of said converging longitudinal tube (T) a guide profile (G) turning towards said lateral direction with respect to the deflector (D), creating a local minimum cross-section liquid passage radially beyond the active ridge (D2) of the deflector approaching the surface (S) to be eroded, then gradually causing said passage section to increase in size, downstream of the deflector and with respect to said surface (S) to cause the pressure to rise and so fix the position of the condensation zone (ZC).

3. A device according to claim 2, wherein the guide profile (G) comprises, in an area of increased passage section downstream of the deflector (D), support fins (G1) extending parallel to said lateral direction and extending along said longitudinal direction having some contact with the surface (S) to be eroded and functioning to hold a predetermined distance between said profile and said surface.

4. A device according to claim 2, wherein the nozzle (B) and the deflector (D) have general forms of revolution about the same axis parallel to said longitudinal direction (A1), a support surface (D1) of the deflector (D) on the surface (S) to be eroded is perpendicular to said axis, the active ridge (D2) is circular and coaxial with the nozzle, said lateral direction being a radial direction with respect to said axis, the gradual increase of the liquid passage section downstream of the deflector resulting at least partially from the increase in the circumferences of the coaxial circles at the nozzle when the liquid becomes more remote from said axis.

5. A device according to claim 4, wherein the deflector (D) is joined to the nozzle (B) by junction fins (D3) fixed to the deflector in planes passing through the axis of the nozzle (A1), said fins being disposed angularly around said axis and grooves (B1) cut into the nozzle within which said fins penetrate.

6. A device according to claim 5, wherein the deflector (D) has the form of a circular disk with two plane parallel faces, and the plane facing the nozzle carrying four junction fins (D3) separated angularly at 90° around the axis of the nozzle.

7. A device according to claim 3, wherein said at least one nozzle consists of several nozzles (B) each fitted with a deflector (D), mounted inside the casing (E1) of a single enclosure (E) with their outputs directed to the exterior of said enclosure, the internal space of the enclosure being supplied by said source of working liquid under high pressure (2) common to all the nozzles, and said nozzles being mounted so as to slide inside said casing so that the pressure held in said internal space keeps the support fins (G1) of all the nozzles in permanent contact with the surface (S) to be eroded.

8. A device according to claim 1, wherein the minimum cross section for the passage of the liquid in the nozzle (B) fitted with its deflector (D) is less than 100 $mm^2$ to obtain a high erosion efficiency.

9. In a process of erosion of a solid surface by a cavitating flow, said process comprising the steps of:

directing a flow of a working liquid under high pressure, said liquid being vaporizable at the ambient temperature at a pressure below the ambient pressure, through a nozzle (B) forming a converging tube (T) in its "longitudinal" direction to form a high speed jet with said liquid, while reducing the pressure of the liquid, and directing said jet toward the surface (S) to be eroded along said longitudinal direction, and creating cavitation in said liquid jet by lowering the pressure locally to partially vaporize the liquid and create violent displacements of the liquid upon recondensation of the vapor in a condensation zone (ZC) where the pressure is raised and which is in contact with the solid surface to be eroded, the improvement wherein said step of creating cavitation comprises urging said jet against a deflector (D) positioned close to the surface (S) to be eroded, such that the deflector receives the jet on its exit from the nozzle (B) and deflects it in a "lateral"

direction parallel to said surface with the edge of said deflector forming an "active" ridge (D2) causing a separation of the flow and the formation of a pocket of vapor (PV) immediately downstream of said ridge between the separated flow and the surface to be eroded.

10. A process according to claim 9, wherein the working liquid is water under pressure.

* * * * *